US006875011B2

(12) United States Patent
Soeda

(10) Patent No.: US 6,875,011 B2
(45) Date of Patent: Apr. 5, 2005

(54) LIGHTER AND FLINT HOLDER

(76) Inventor: Masasuke Soeda, 15-6-206, Shin machi 2-chome, Nishi-ku Osaka City Osaka Pref. (JP)

( * ) Notice: Subject to any disclaimer, the term of this patent is extended or adjusted under 35 U.S.C. 154(b) by 0 days.

(21) Appl. No.: 10/382,593

(22) Filed: Mar. 6, 2003

(65) Prior Publication Data

US 2003/0180675 A1 Sep. 25, 2003

(30) Foreign Application Priority Data

Mar. 20, 2002 (JP) ..... 2002-078809

(51) Int. Cl.[7] ..... F23Q 2/38
(52) U.S. Cl. ..... 431/124; 431/276; 206/531
(58) Field of Search ..... 431/124, 276, 431/253, 273; 206/531, 486, 216, 539, 538, 488; 222/192

(56) References Cited

U.S. PATENT DOCUMENTS 2,352,319 A * 6/1944 Harris ..... 206/539
2,710,709 A * 6/1955 Bowers ..... 431/124
2,825,216 A * 3/1958 Mosch ..... 431/124
3,128,878 A * 4/1964 Ring ..... 206/531
3,322,269 A * 5/1967 Neyer ..... 206/488
3,464,776 A * 9/1969 Ferrara ..... 431/124
3,728,070 A * 4/1973 Rowlett ..... 431/124
4,865,541 A * 9/1989 Okada ..... 431/124

FOREIGN PATENT DOCUMENTS

DE 389 105 A * 7/1922 ..... 431/124
JP 2002-162034 7/2002

* cited by examiner

*Primary Examiner*—Josiah C. Cocks
(74) *Attorney, Agent, or Firm*—Marshall, Gerstein & Borun LLP

(57) ABSTRACT

A flint is easy to take out of a flint holder, which can be carried in a lighter. The flint holder consists of a holding part in the form of a thin plate, a fitting part and a molded hinge part, which integrally connects the holding and fitting parts in such a manner that they can bend. The holding part has parallel slots formed through it side by side at regular intervals. Each of the slots can be loaded with a columnar flint. The fitting part has a fitting hole, with which a screw can engage to fit the flint holder to the lighter.

4 Claims, 8 Drawing Sheets

(a)

(b)

PRIOR ART

LIGHTER AND FLINT HOLDER

FIELD OF THE INVENTION

The present invention relates to a lighter with a flint, which can be filed to spark. Principally, the invention relates to an oil lighter, which burns volatile oil as fuel. Particularly, the invention relates to a portable flint holder and a lighter fitted with a flint holder in it.

BACKGROUND OF THE INVENTION

An oil lighter lights principally with a flint. In general, the user of an oil lighter carries some flints about in case the flints in it are used up.

FIG. 8 of the accompanying drawings shows a conventional flint holder 70 used in general. The holder 70 is made of hard synthetic resin and includes a body 71, which supports a wheel or rotary head 73 on its one end. The body 71 has a longitudinal hole 72 for storing some cylindrical or columnar flints A in series. The wheel 73 has a radial hole 73*a* for holding one flint A. The radial hole 73*a* can communicate with the longitudinal hole 72.

With one flint A shifted from the body hole 72 to the wheel hole 73*a*, it is possible to take out the flint by turning the wheel 73 in one direction. It is also possible to make the holes 72 and 73*a* communicate with each other by turning the wheel 73 in the opposite direction. Thus, the flint holder 70 is easy to operate.

However, the user of an oil lighter needs to carry a flint holder along with it. The flint holder itself is very small and light in weight. However, because the flint holder may be used only once in some weeks, the user may lose it or forget to carry it.

SUMMARY OF THE INVENTION

An object of the present invention is to provide a flint holder that can be carried in a lighter, and from which a flint can be easily taken. Another object is to provide a lighter fitted with such a flint holder.

A flint holder according to the present invention comprises a thin plate, which includes a holding part and a fitting part. The holding part is molded out of soft resin. This part has slots formed through it for holding columnar flints at regular intervals in such a manner that the flints can be detached from the slots. The fitting part has a fitting hole formed through it.

The flint holder, which comprises a thin plate made at least partially of soft resin, is small, light in weight and convenient to carry about. The small holder can be put in a space in a lighter or a cigarette case. The flint holder can be fixed with its fitting hole screwed on. Because at least the holding part is made of soft resin and flexible, the flint holder can bend or otherwise deform so that flints can be easily taken from it, and flints cannot be damaged while they are held by the holder.

In general, a flint type lighter has a threaded hole formed in its bottom, which can be loaded with a flint. The threaded hole engages with a screw, which can fix the flint holder to the bottom of the lighter. This avoids the contingency that no flint would otherwise be available when the flint in the lighter is used up, as is the case with the conventional flint holder, which is carried about separately from a lighter.

The slots of the holding part may be arranged side by side at regular intervals. The fitting part may be molded out of soft resin. The holding and fitting parts may be connected together by a molded hinge part in such a manner that the flint holder can bend.

The flint holder that comprises a thin plate made wholly of soft resin is small, light in weight and convenient to carry about. The small holder can be put in a space in a lighter or a cigarette case. The flint holder can be fixed with its fitting hole screwed on. The holding part can be bent at the hinge part, even with the fitting part fixed to a lighter or the like. This makes it easy to take out flints without detaching the flint holder.

The holding part may be flat on one side and include first pairs of overhangs formed on this side. Each first pair of overhangs hangs over both sides of one of the slots to engage with the flint held by the slot. The holding part may also include walls formed on its other side. Two of the walls are each positioned on the outer side of one of the end slots. The other walls are each positioned between adjacent ones of the slots in such a manner that the flint held by each of the slots protrudes slightly from the associated walls. The holding part may further include second pairs of overhangs. Two of the second pairs of overhangs each hang from one of the end walls over one side of the adjacent slot to engage with the flint held by the slot. The other second pairs of overhangs each hang from one side of one of the intermediate walls over one side of the adjacent slot to engage with the flint held by the slot.

In this case, the flint holder is thinner than the diameter of the columnar flints. Besides, the flints held by the slots do not easily fall down, but they can be easily taken out with the holding part bent.

The fitting part may include a main body, through which the fitting hole is formed. The fitting part may also include a connector for detachably engaging with one end of the holding part. The fitting part may further include a hinge, which connects the main body and the connector together.

In this case, when the flints held by the flint holder are used up, only the holding part can be replaced with a new loaded one. Accordingly, the flint holder is more economical than a flint holder that needs to be wholly replaced. The fitting part may be made of an aluminum alloy or another metal. In this case, with the flint holder fitted to a lighter, the hinge of the fitting part allows the holding part to smoothly pivot. This makes it easier to take out a flint.

The holding part may be made of polypropylene. In the case of the flint holder being fitted in an oil lighter, the holding part made of polypropylene neither deform nor discolor even if it comes in contact with the felt pad impregnated with fuel oil, the main ingredient of which is butane.

A lighter according to the present invention includes an outer cover and a main body. The outer cover has a cap and can cover the main body. The main body has a threaded hole formed therethrough between its top and bottom. A spring is put in the threaded hole to urge a flint toward the top of the threaded hole. A screw engages with the bottom of the threaded hole. A flint holder as described above is fitted in a space at the bottom of the main body, with the screw engaging with the threaded hole.

Because flints can be carried in the lighter, one of them can be taken out of it and used immediately when the flint in the lighter is used up or worn away.

BRIEF DESCRIPTION OF THE DRAWINGS

Preferred embodiments of the present invention are shown in the accompanying drawings, in which:

FIG. 1(*b*) is an end view of the first flint holder;

FIG. 1(*c*) is a side view of the first flint holder;

FIG. 1(*d*) is a bottom plan of the first flint holder;

FIG. 1(*e*) is a cross section taken along line e—e of FIG. 1(*a*);

FIG. 2(*b*) is a lower perspective view of the first flint holder;

FIG. 4(*b*) is a side view partially in vertical section of the main body of the oil lighter;

FIG. 6(*b*) is a side view of the third flint holder;

FIG. 6(*c*) is another top plan of the third flint holder, showing the separated holding and fitting parts;

FIG. 6(*d*) is a side view of the third flint holder as shown in FIG. 6(*c*);

FIG. 6(*e*) is an enlarged cross section taken along line e—e of FIG. 1(*b*);

FIG. 7(*b*) is an enlarged cross section taken along line b—b of FIG. 7(*a*);

PREFERRED EMBODIMENTS OF THE INVENTION

Figure 4:
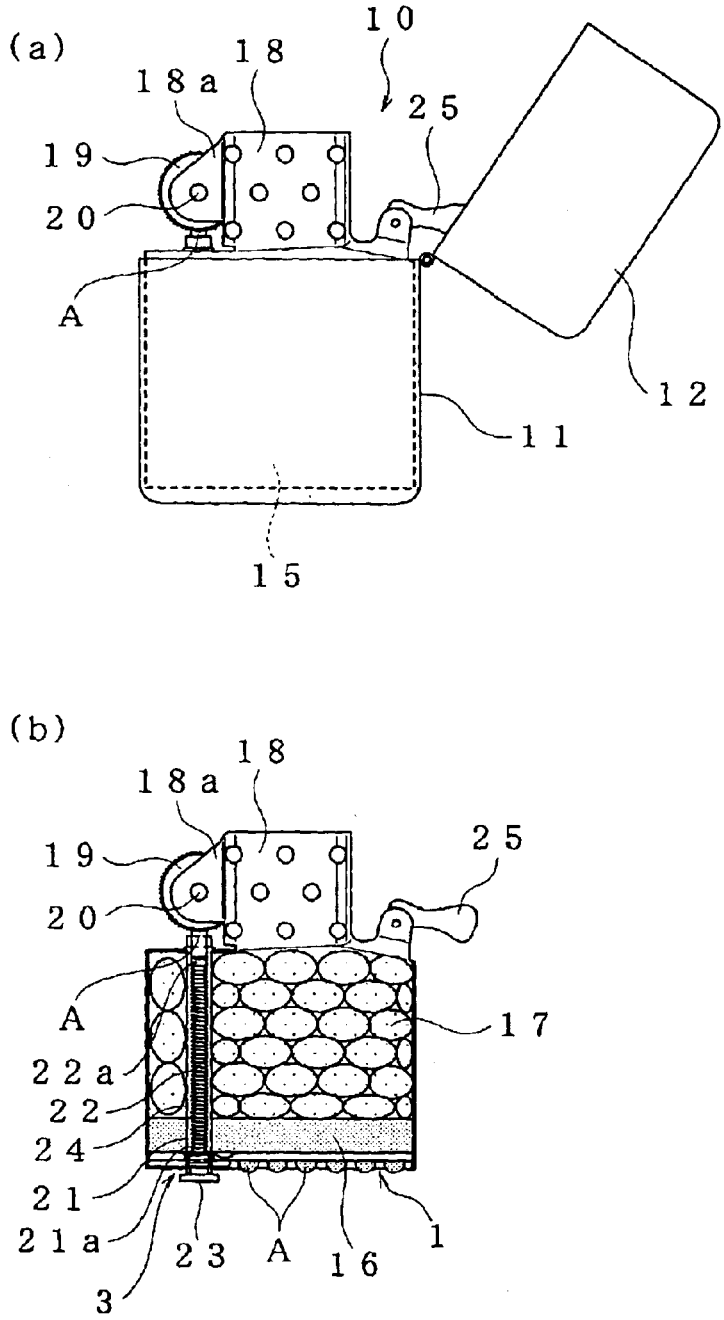
FIG. 4(*a*) is a side view of an oil lighter embodying the invention.
Figure 5:
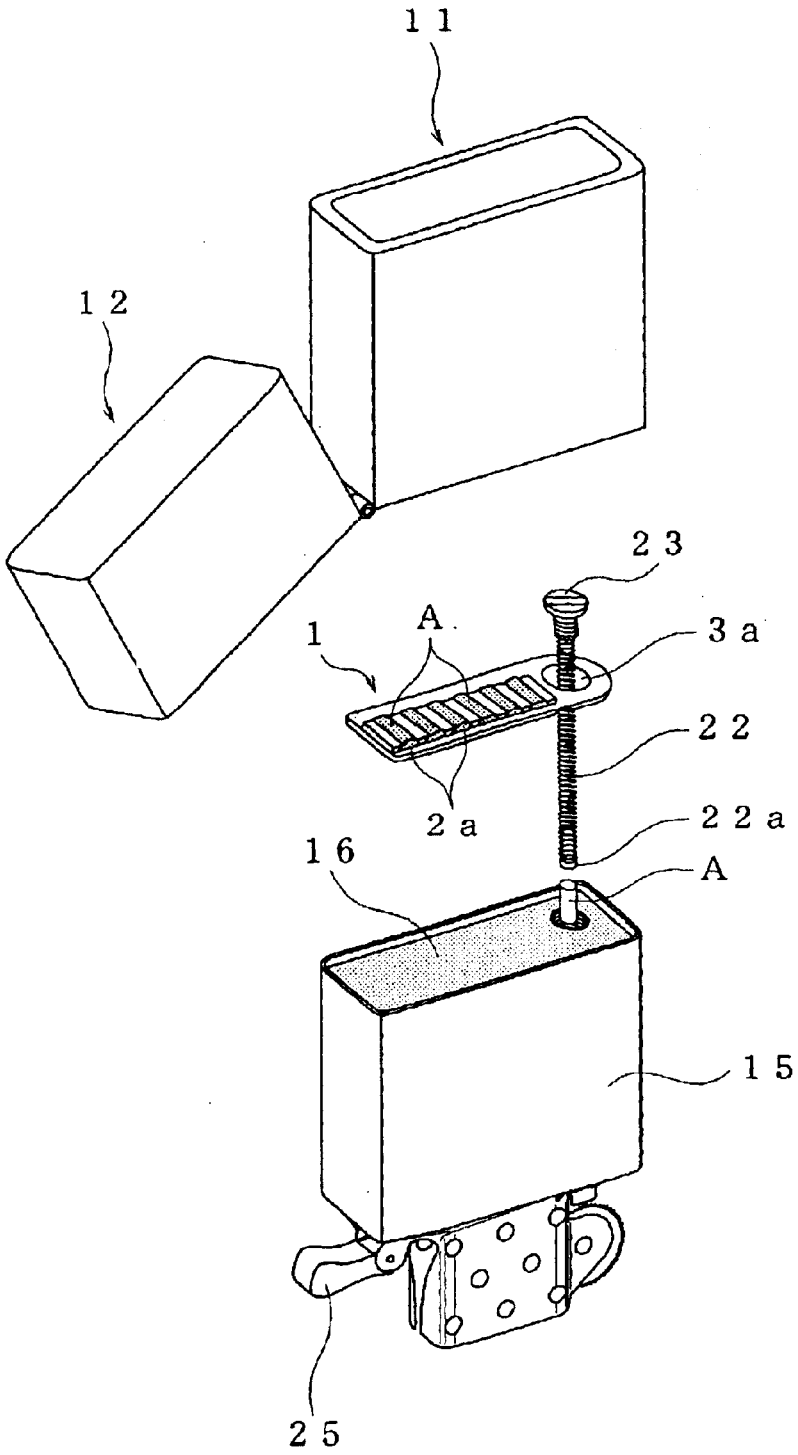
FIG. 5 is an exploded view of the oil lighter.

FIGS. 4 and 5 show an oil lighter 10 embodying the present invention. The main ingredient of the fuel for the oil lighter 10 is butane. The oil lighter 10 includes a main body 15, which is fitted with a flint holder 1 under its bottom. The flint holder 1 is integrally molded out of soft synthetic resin. It is preferable that this resin be polypropylene, which the lighter fuel neither deforms nor discolors.

The oil lighter 10 also includes an outer cover 11, which is fitted with a pivoted cap 12. The outer cover 11 can be detached from the lighter body 15. The lighter body 15 is fitted with a felt pad 16 in the form of a plate at its bottom and loaded with a number of rayon balls 17 on the pad 16. It is possible to impregnate the rayon balls 17 with volatile oil fuel by pulling off one end of the felt pad 16. The oil fuel is then soaked up by the lighter wick (not shown). The lighter body 15 has a firing cover 18 with a side wall 18*a*, by which a flint wheel 19 is supported rotatably on a rivet 20. The flint wheel 19 can be turned to file a flint, which then emits sparks to ignite the volatile fuel.

The lighter body 15 has a bore 24 extending through it from the bottom felt pad 16. A tube 21 extends through the bore 24. A flint A and a long coil spring 22 are inserted in order into the tube 21 from the bottom of the lighter body 15. The coil spring 22 is fitted with a tip 22*a* on its one end and urges the flint A against the flint wheel 19. The bottom of the tube 21 has an internal thread (threaded hole) 21*a*, with which a screw 23 engages to hold the coil spring 22 and the flint A in the tube 21.

The lighter body 15 is fitted with a cam 25. The foregoing structure of the oil lighter 10 is known.

The flint holder 1 is put in the space between the felt pad 16 at the bottom of the lighter body 15 and the bottom of the outer cover 11. It is therefore required that the flint holder 1 be a plate as thin and light in weight as possible. It is also required that the flint holder 1 neither be discolored nor deformed by its contact with the oil fuel with which the felt pad 16 is impregnated.

The flint holder 1 consists of a rectangular holding part 2 in the form of a thin plate, a fitting part 3 and a molded hinge part 4. The holding part 2 has six parallel slots 2*a* formed side by side at regular intervals. Each of the slots 2*a* can be loaded with a columnar flint A. The fitting part 3 has a circular fitting hole 3*a* formed through it for engaging with the screw 23, which can detachably fix the flint holder 1 to the lighter body 15. The hinge part 4 connects the other parts 2 and 3 integrally in such a manner that the flint holder 1 can bend.

Figure 1:
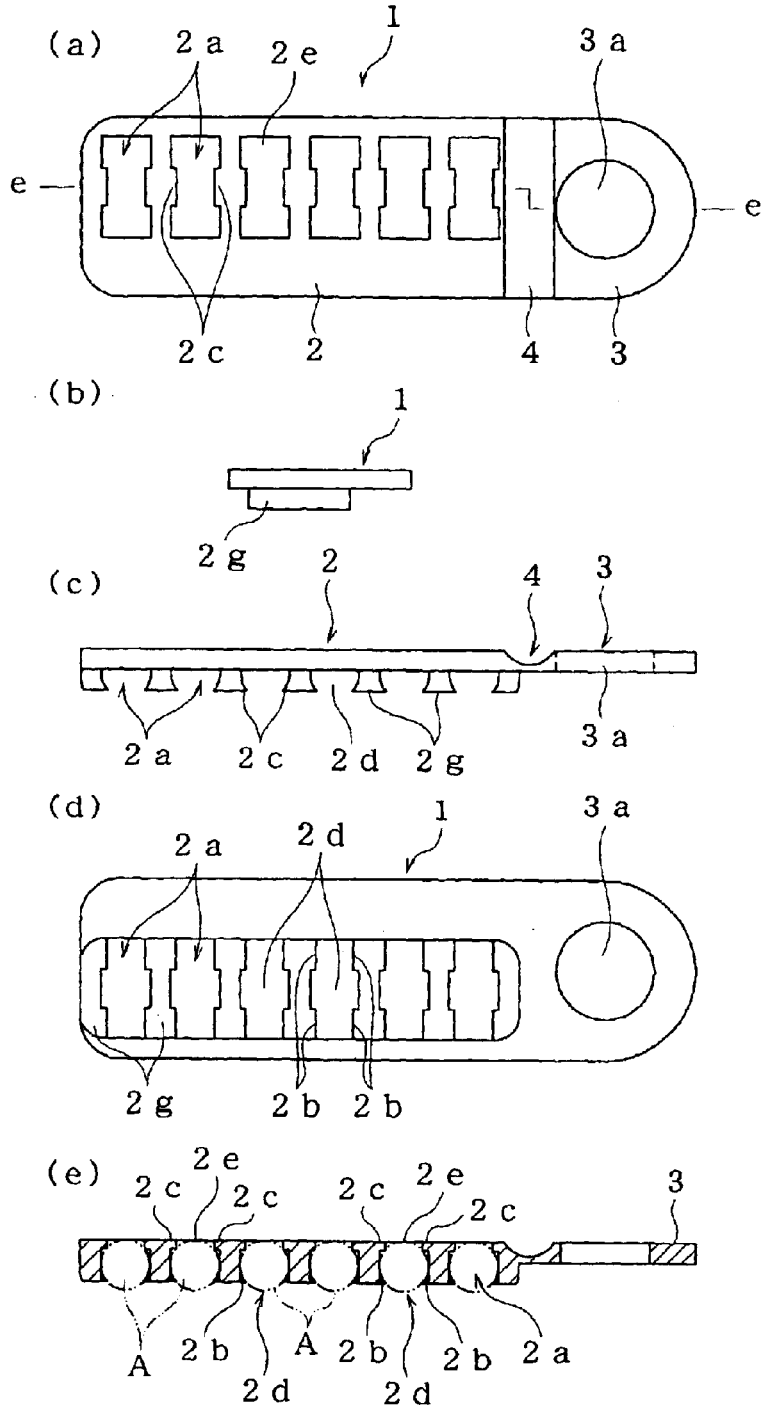
FIG. 1(*a*) is a top plan of a first flint holder embodying the invention.
Figure 2:
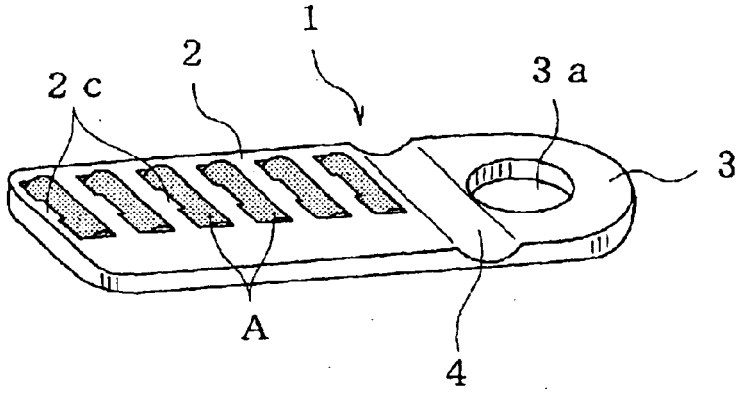
FIG. 2(*a*) is an upper perspective view of the first flint holder.
Figure 2:
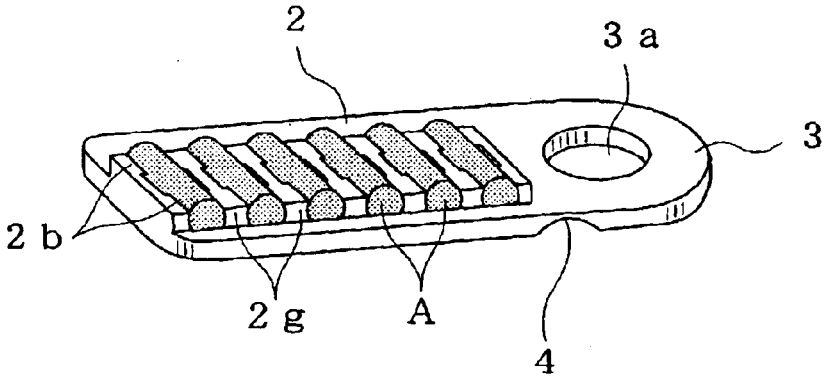

As shown in FIGS. 1 and 2, the holding part 2 should be as thin as possible so that a flint A protrudes partially from the openings 2*d* and 2*e* of each slot 2*a* on both sides of the part 2. The holding part 2 has seven parallel walls 2*g* formed on its lower side. Each of the slots 2*a* is positioned between two of the walls 2*g*. Each of the two end walls 2*g* has a pair of overhangs 2*b* formed on its inner side. Each of the five intermediate walls 2*g* has a pair of overhangs 2*b* formed on each side. Each pair of overhangs 2*b* hangs over the adjacent slot 2*a* into engagement with end portions of the associated flint A. The holding part 2 has twelve overhangs 2*c* formed on its upper side. Each of the overhangs 2*c* is formed on one side of one of the slots 2*a*. Each of the overhangs 2*c* hangs over the adjacent slot 2*a* into engagement with a middle portion of the associated flint A. The overhangs 2*b* and 2*c* on both sides of the holding part 2 can thus hold the flints A securely in the slots 2*a*.

The fitting part 3 of the flint holder 1 is semi-circular, and its fitting hole 3*a* is formed through its center. The hinge part 4 of the holder 1 is grooved on its upper side so that it is easy to bend.

The flint holder 1 may be integrally injection-molded.

Figure 3:
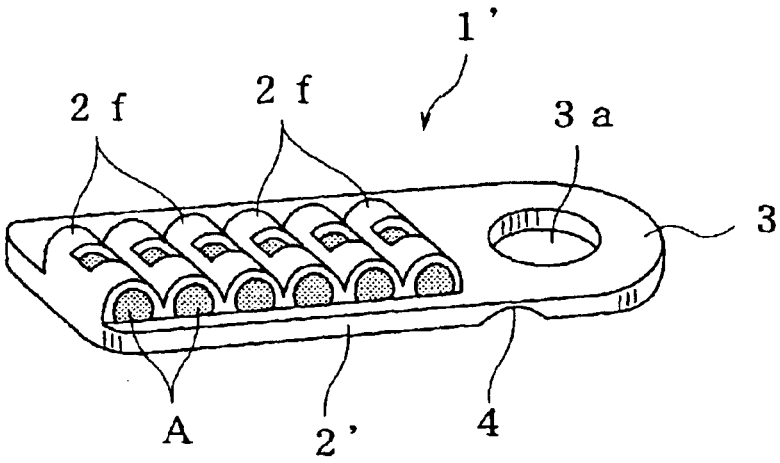
FIG. 3 is a lower perspective view of a second flint holder embodying the invention.

FIG. 3 shows another flint holder 1' embodying the present invention. The flint holder 1' includes a holding part 2', a fitting part 3 and a molded hinge part 4. The holding part 2' has six parallel openings 2*e* formed on its upper side, each of which can be loaded with a columnar flint A. The holding part 2' also has twelve overhangs 2*c* formed on its upper side. Each of the overhangs 2*c* is formed on one side of one of the parallel openings 2*e*. The holding part 2' further has six semi-cylindrical pods 2*f* formed on its lower side. Each of the pods 2*f* communicates with one of the openings 2*e*. Because each of the pods 2*f* partially covers a columnar flint A and is accordingly larger than it in diameter, the holding part 2' is somewhat thicker than the holding part 2 of the foregoing embodiment. The fitting part 3 and the hinge part 4 are identical with those of the foregoing embodiment.

The flint holders 1 and 1' can be used in the same way. The way to use the flint holder 1 is described below.

As shown in FIG. 5, the flint holder 1 is fixed on the felt pad 16 by the screw 23, with each slot 2*a* loaded with a columnar flint A. Then, the flint holder 1 and the lighter body 15 are covered with the outer cover 11. The oil lighter 10 fitted with the flint holder 1 in it can be carried about and used in a way similar to the conventional way. If the flint A in contact with the flint wheel 19 is used up while the lighter 10 is used, the outer cover 11 is removed, as shown in FIG. 4. Then, the holding part 2 of the flint holder 1 is turned up, with the fitting part 3 fixed to the bottom of the lighter body 15. Alternatively, the flint holder 1 is detached from the lighter body 15, with the screw 23 removed, and the holding part 2 is bent longitudinally. This opens the openings 2*e* wide so that a flint A can be taken from any one of the slots 2*a*.

The taken flint A is loaded into the bore 24 of the lighter body 15. Then, with the coil spring 22 inserted into the bore 24, the screw 23 is tightened through the fitting hole 3*a* to fix the flint holder 1 to the bottom of the lighter body 15.

Then, the flint holder 1 and the lighter body 15 are covered with the outer cover 11. This ends flint replacement, and the oil lighter 10 can then be used.

Figure 6:
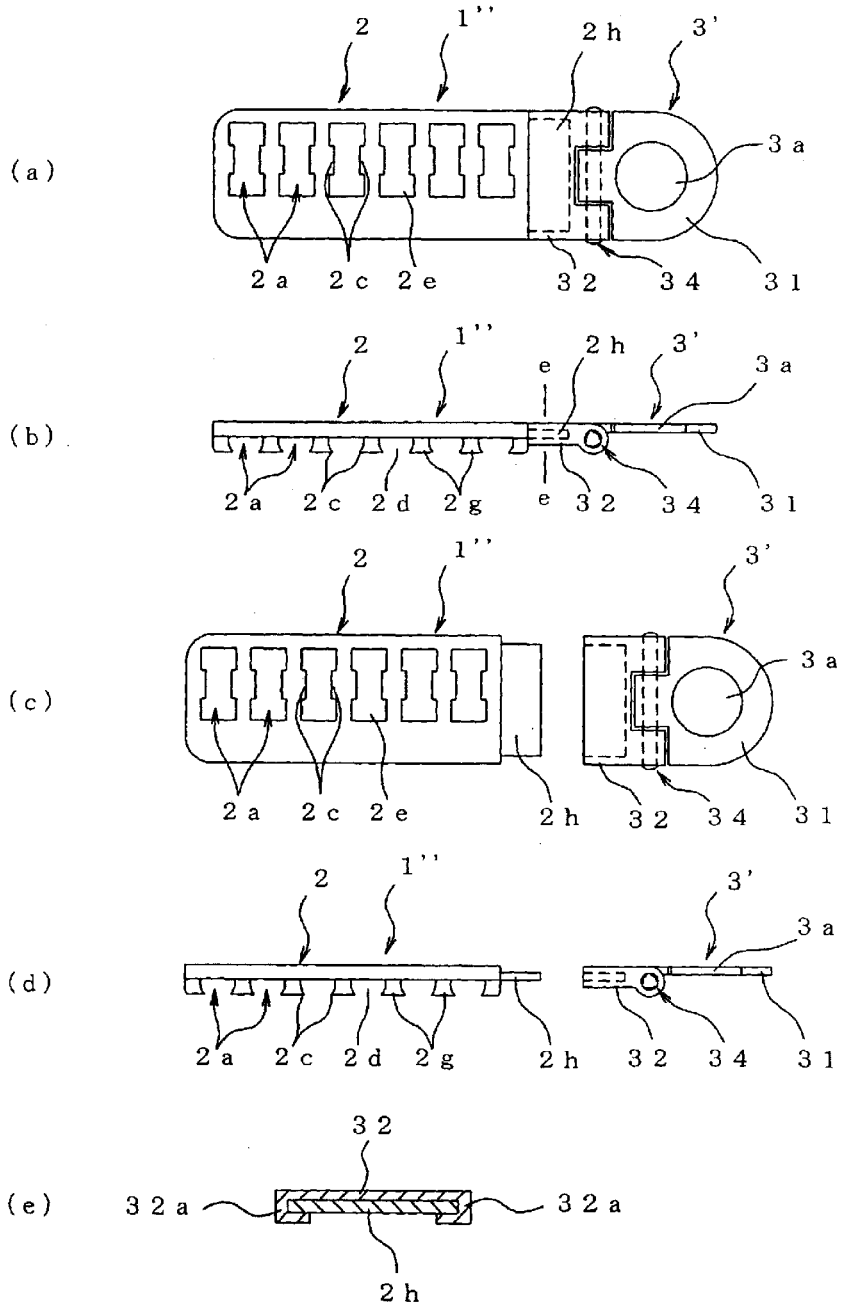
FIG. 6(*a*) is a top plan of a third flint holder embodying the invention.

FIGS. 6(*a*)–6(*e*) show still another flint holder 1" embodying the present invention. The flint holder 1" consists of a thin holding plate 2 made of soft resin and a separate fixture 3' made of an aluminum alloy or another metal. The holding plate 2 has a tongue 2*h*. The fixture 3' consists of a main body 31, a connector 32 and a hinge 34, which corresponds to the hinge part 4. The hinge 34 connects the main body 31 and the connector 32 together. The main body 31 has a fitting hole 3*a* formed through it for engaging with the screw 23. The connector 32 includes side edge portions 32*a* turning downward and inward for engaging with both side edges of the tongue 2*h*.

Figure 7:
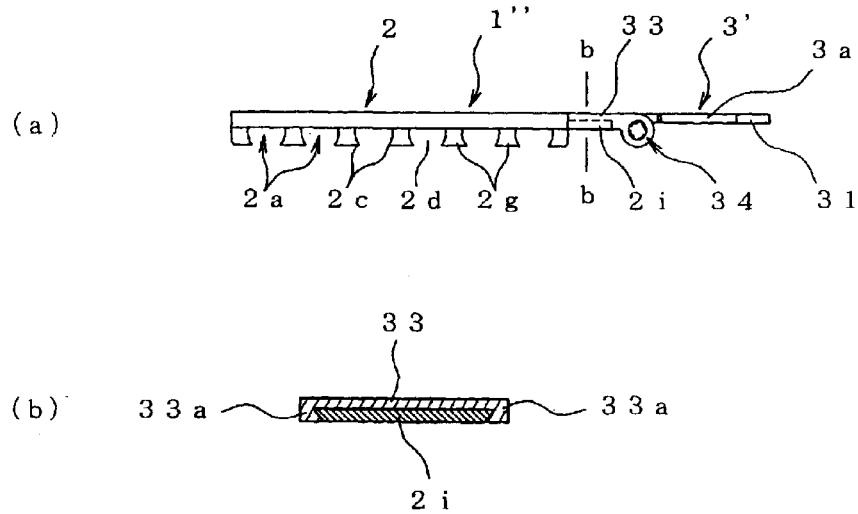
FIG. 7(*a*) is a side view of a fourth flint holder embodying the invention.
Figure 8:
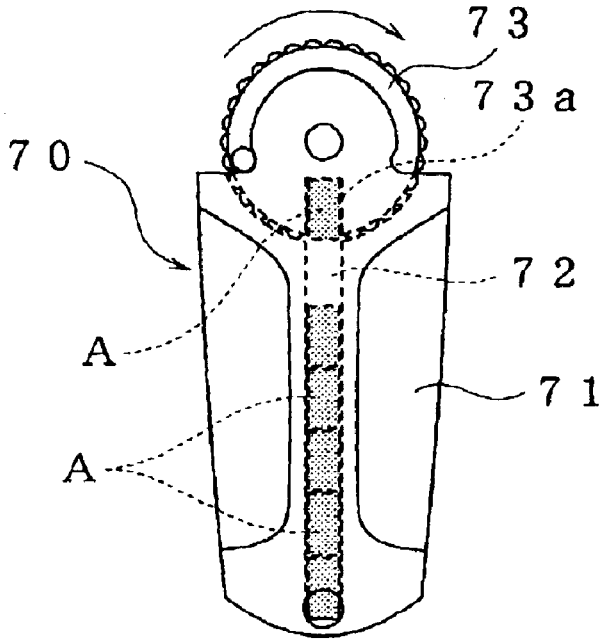
FIG. 8 is a front view of a conventional flint holder.

FIGS. 7(*a*) and 7(*b*) show yet another flint holder 1" embodying the present invention. This flint holder 1" consists of a holding plate 2 and a separate fixture 3'. The holding plate 2 consists of a main body and a tongue 2*i*. The fixture 3' consists of a main body 31, a connector 33 and a hinge 34. The main bodies of the holding plate 2 and fixture 3', and the hinge 34 are identical with the counterparts shown in FIGS. 6(*a*)–6(*e*). As shown in FIG. 7(*b*), both side edges of the tongue 2*i* incline inward from its top. As also shown, the connector 33 includes side edge portions 33*a* protruding downward. The inner sides of the edge portions 33*a* incline so as to engage with the side edges of the tongue 2*i*. The bottoms of the connector 33 and tongue 2*i* are flush with each other. Consequently, with the tongue 2*i* engaging with the connector 33, this connector is thinner than the connector 32 of FIGS. 6(*a*)–6(*e*). Besides, the connector 33 is simpler in structure.

When the flints A held by the flint holder 1" shown in each of FIGS. 6 and 7 are used up, only the associated holding plate 2 can be replaced with a new one loaded with flints A. The fixtures 3' do not need to be removed from the respective lighter bodies 15. Consequently, the flint holders 1" are more economical than the holders 1 and 1', the wholes of which need replacing.

The present invention can be applied to not only oil lighters but also gas lighters that are flint type lighters. If a gas lighter has a space in it or at its bottom, a flint holder according to the invention can be fitted in the space.

As far as each of the flint holders 1 and 1' has a hole for fitting it to a lighter, its hinge part 4 might be excluded (omitted). The slots or recesses for holding flints might be arranged arbitrarily as far as many flints can be stored in the predetermined space.

What is claimed is:

1. A flint holder for lighters that have a conventional lighter body, a conventional flint screw on the bottom of the lighter body, and a conventional space between the bottom of the lighter body and a conventional removable outer cover, the flint holder comprising:

a rectangular holding part in the form of a thin plate molded out of soft resin that is sized to be received in the conventional space between the bottom of the conventional lighter body and the conventional removable outer cover and having a plurality of parallel slots formed therethrough for holding columnar flints at regular intervals in such a manner that the flints can be detached from the slots;

a fitting part having a fitting hole formed therethrough that is configured to be engaged on the conventional flint screw on the bottom of the lighter body; and a hinge part in the form of a relatively-wide groove between the holding and fitting parts that enables the flint holder to bend away from the bottom of the conventional lighter body, across the width of the flint holder.

2. A lighter comprising:

an outer cover including a cap;

a main body that can be covered by the outer cover, the body having a threaded hole formed therethrough between the top and bottom thereof;

a spring in the threaded hole to urge a flint toward the top of the hole;

a screw engaging the bottom of the threaded hole; and a flint holder according to claim 1 and fitted in a space at the bottom of the main body, with the screw engaging with the threaded hole.

3. A flint holder comprising a thin plate including:

a fitting part that includes:

a fitting hole;

a main body through which the fitting hole is formed;

a connector for detachably engaging one end of the holding part;

a hinge connecting the main body and the connector together;

a holding part that is flat on one side, is molded out of soft resin, and has (i) a plurality of slots formed therethrough for holding columnar flints at regular intervals in such a manner that the flints can be detached from the slots, (ii) first pairs of overhangs formed on the flat side and hanging over both sides of one of the slots to engage with the flint held by the slot; (iii) walls formed on the other side of the holding part, two of the walls each positioned on the outer side of one of the end slots, the other walls each positioned between adjacent ones of the slots in such a manner that the flint held by each of the slots protrudes slightly from the associated walls, and (iv) second pairs of overhangs, two of the second pairs each hanging from one of the end walls over one side of the adjacent slot to engage with the flint held by the slot, the other second pairs each hanging from one side of one of the intermediate walls over one side of the adjacent slot to engage with the flint held by the slot; and a molded hinge part between the holding and fitting parts that enables the flint holder to bend across the width of the flint holder.

4. A lighter comprising:

an outer cover including a cap;

a main body that can be covered by the outer cover, the body having a threaded hole formed therethrough between the top and bottom thereof;

a spring in the threaded hole to urge a flint toward the top of the hole;

a screw engaging the bottom of the threaded hole; and a flint holder according to claim 3 and fitted in a space at the bottom of the main body, with the screw engaging with the threaded hole.

* * * * *